US008313187B2

(12) United States Patent
Barnett et al.

(10) Patent No.: US 8,313,187 B2
(45) Date of Patent: Nov. 20, 2012

(54) MODULAR RFID IMAGING DEVICE OPTION

(75) Inventors: Albert Tyler Barnett, Georgetown, KY (US); Rick Kallop, Lexington, KY (US); Raymond Michael Marowski, Lexington, KY (US); Carl Nieland, Lexington, KY (US); Evan J. Powers, Philadelphia, PA (US); Steven Eugene Ritter, Nicholasville, KY (US); Tim Rowland, Nicholasville, KY (US); Forrest Steely, Lexington, KY (US); Mark Stephen Underwood, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 774 days.

(21) Appl. No.: 12/112,503

(22) Filed: Apr. 30, 2008

(65) Prior Publication Data

US 2009/0274504 A1 Nov. 5, 2009

(51) Int. Cl.
*B41J 2/01* (2006.01)
*B41J 29/38* (2006.01)

(52) U.S. Cl. ..... 347/101; 347/104; 347/105; 347/16

(58) Field of Classification Search ..... 347/5, 9, 347/14, 16, 101, 104, 2
See application file for complete search history.

(56) References Cited

U.S. PATENT DOCUMENTS

| | | | | |
|---|---|---|---|---|
| 4,958,822 | A | 9/1990 | Rutishauser et al. | |
| 5,727,464 | A | 3/1998 | Bahrami et al. | |
| 5,838,253 | A * | 11/1998 | Wurz et al. | 340/10.42 |
| 6,019,865 | A * | 2/2000 | Palmer et al. | 156/265 |
| 6,099,178 | A * | 8/2000 | Spurr et al. | 400/207 |
| 6,106,166 | A * | 8/2000 | Spurr et al. | 396/578 |
| 6,246,326 | B1 * | 6/2001 | Wiklof et al. | 340/572.1 |
| 6,409,401 | B1 * | 6/2002 | Petteruti et al. | 400/88 |
| 6,593,853 | B1 * | 7/2003 | Barrett et al. | 340/572.1 |
| 6,628,316 | B1 * | 9/2003 | Spurr et al. | 346/134 |
| 6,710,891 | B1 * | 3/2004 | Vraa et al. | 358/1.12 |
| 6,712,446 | B1 * | 3/2004 | Huffman | 347/19 |
| 6,793,307 | B2 * | 9/2004 | Spurr et al. | 347/14 |
| 6,808,255 | B1 * | 10/2004 | Haines et al. | 347/86 |
| 6,811,079 | B1 * | 11/2004 | Vraa et al. | 235/383 |
| 6,899,476 | B1 * | 5/2005 | Barrus et al. | 400/76 |
| 7,073,712 | B2 * | 7/2006 | Jusas et al. | 235/451 |
| 7,382,990 | B2 * | 6/2008 | Park et al. | 399/24 |
| 7,394,373 | B2 * | 7/2008 | Park et al. | 340/572.1 |
| 7,411,502 | B2 * | 8/2008 | Collins et al. | 340/572.1 |
| 7,969,317 | B2 * | 6/2011 | Oyumi | 340/593 |
| 7,979,019 | B2 * | 7/2011 | Yoshino | 399/366 |
| 2001/0036380 | A1 * | 11/2001 | Spurr et al. | 400/249 |
| 2005/0252968 | A1 * | 11/2005 | Tsujimura et al. | 235/439 |
| 2007/0003339 | A1 | 1/2007 | Edwards et al. | |
| 2008/0165009 | A1 * | 7/2008 | Hirota | 340/572.1 |

FOREIGN PATENT DOCUMENTS

JP 2006103284 A * 4/2006

* cited by examiner

*Primary Examiner* — Stephen Meier
*Assistant Examiner* — Leonard S Liang

(57) ABSTRACT

A device, method, system and article for controlling an image forming device including removable RFID functionality. A print job may be received and a determination may be made as to whether the print job includes RFID data. The RFID data may be sent to a removable RFID module when RFID data is included in the print job. Media may then be provided to a first paper path defined in the removable RFID module when RFID data is included in the print job and provided to a second paper path defined in the image forming device. An image may then be formed on the media.

28 Claims, 13 Drawing Sheets

MODULAR RFID IMAGING DEVICE OPTION

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to image forming devices and, in particular, to modular units that may be utilized to provide RFID print functionality to an image forming device.

2. Description of the Related Art

Inkjet and laser printers are common in most workplace and home computing environments. Today, many printers may include multi-functional assemblies capable of printing on a large array of print media including letterhead, paper envelopes and labels. A recent innovation in the printing industry involves the manufacturing of print media with embedded radio frequency signatures in the form of Radio Frequency Identification (RFID) transponders or tags. These tags, sometimes called "Smart Labels", may be used with a variety of existing printing methods.

Embedded print media may include a backing material (sometimes referred to as the "web") upon which a label is applied, with a RFID tag sandwiched in between the label and the backing material. There may be one or more labels on the web and the sheet, as presented, may be part label and part plain paper. In some cases there may be more than one tag arrayed across the width and down the length of the media such that multiple columns and/or rows of tags are contained on the print media.

Printing on media with embedded RFID tags is rapidly becoming a growing area of label printing. Each tag on a sheet may be printed with certain data, and the RFID tag embedded within that media may be used to allow individualized processing of user associated data. For example, a shipping label might have the delivery address and a package tracking ID printed on it, while the corresponding tag would be programmed with the same information. The delivery information may then be read from the tag, whether or not the package is positioned so that the tag is visible.

To obtain RFID functionality a consumer may need to buy a new printer. However, many consumers already own printers and may not want to deal with the space, money and other associated issues in owning an RFID printer in conjunction with other printing devices. In addition, consumers may not accept the waste associated in replacing a functional printer with a printer including RFID functionality.

SUMMARY OF THE INVENTION

An aspect of the present disclosure relates to a device for providing RFID functionality to an image forming device. The device may include a removable RFID module defining a first paper path configured to communicate with a second paper path defined in the image forming device. The device may also include an RFID reader/programmer positioned within the module in electrical communication with the image forming device and an RFID antenna positioned within the module in electrical communication with the RFID reader/programmer.

Another aspect of the present disclosure relates to a system for providing RFID functionality. The system may include an image forming device including a controller defining a first paper path and a removable RFID module defining a second paper path in communication with the first paper path. The module may include an RFID reader/programmer positioned within the module in electrical communication with the controller, and an RFID antenna positioned within the module in electrical communication with the RFID reader/programmer.

A further aspect of the present disclosure relates to a method for controlling an image forming device including removable RFID functionality. The method may include receiving a print job, determining if the print job includes RFID data and sending RFID data to a removable RFID module when RFID data is included in the print job. The method may also include providing media to a first paper path defined in the RFID module when RFID data is included in the print job, programming the media and providing the media to a second paper path defined in an image forming device, which may then form an image on the media.

Yet another aspect of the present disclosure relates to an article, comprising a storage medium. The storage medium may have stored thereon instructions that when executed by a machine result in the following operations of receiving a print job, and determining if the print job includes RFID data. The instructions may also include providing media to a first paper path defined in a removable RFID module when RFID data is included in the print job, programming the media, providing the media to a second paper path defined in an image forming device, and forming an image on the media.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
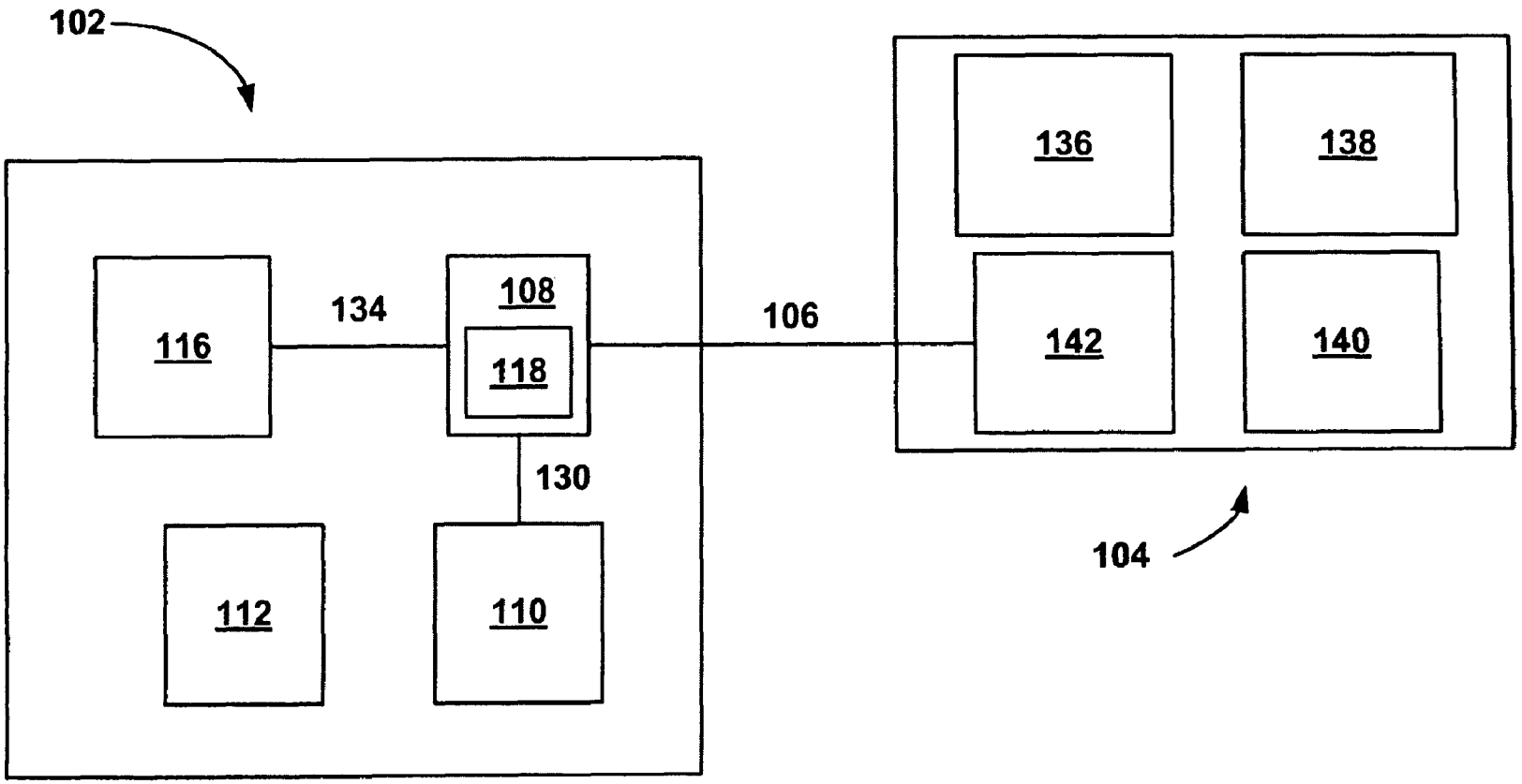
FIG. 1 is a schematic of an example of an image forming device and a computer.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present disclosure relates to a device, system, method and article for providing removable radio frequency identification (RFID) functionality to an image forming device. An image forming device may be understood as any device capable of providing images. Such devices may include fax machines, copiers, printers, multi-function device or all-in-one devices and may utilize electrophotographic, inkjet, solid ink, thermal transfer and other printing systems. The RFID functionality may be provided by a removable module, which may be attached or removed from the image forming device. For example, the removable module may be encased in a housing for ease of connectivity with the printer, it may include alignment features to engage with the printer and or electrical connections that may be keyed to engage and communicate with the image forming device controller. RFID functionality may include the ability to read and/or program RFID tags, which may be embedded in or positioned on a sheet of media. Media may include paper, fabric, films and other substrates or carriers upon which an image may be formed.

Illustrated in FIG. 1, is an example of an image forming device 102. The image forming device 102 may include a controller 108, a print engine 110, a printing cartridge 112, and a user interface 116. The image forming device 102 may communicate with computer 104 via a standard communication protocol, such as for example, universal serial bus (USB), Ethernet or IEEE 802.xx. Controller 108 may include a processor unit and associated memory 118, and may be formed as one or more Application Specific Integrated Circuits (ASIC). Memory 118 may be, for example, random access memory (RAM), read only memory (ROM), and/or non-volatile RAM (NVRAM). Alternatively, memory 118 may be in the form of a separate electronic memory (e.g., RAM, ROM, and/or NVRAM), a hard drive, a CD or DVD drive, or any memory device convenient for use with controller 108. Controller 108 may be, for example, a combined printer and scanner controller.

Controller 108 may communicate with print engine 110 via a communications link 130. User interface 116 may be communicatively coupled to controller 108 via a communications link 134. Controller 108 may serve to process print data and to operate print engine 110 during printing. Computer 104, which may be optional, may be, for example, a personal computer, including memory 136, such as RAM, ROM, and/or NVRAM, an input device 138, such as a keyboard, and a display monitor 140. Computer 104 may further includes a processor, input/output (I/O) interfaces, and may include at least one mass data storage device, such as a hard drive, a CD-ROM and/or a DVD unit.

Computer 104 may include in its memory a software program including program instructions that function as an imaging driver 142, e.g., printer/scanner driver software, for image forming device 102. Imaging driver 142 may be in communication with controller 108 of image forming device 102 via communications link 106. Imaging driver 142 may facilitate communication between imaging apparatus 102 and computer 104. One aspect of imaging driver 142 may be, for example, to provide formatted print data to image forming device 102, and more particularly, to print engine 110, to print an image.

In some circumstances, it may be desirable to operate image forming device 102 in a standalone mode. In the standalone mode, image forming device 102 is capable of functioning without computer 104. Accordingly, all or a portion of imaging driver 142, or a similar driver, may be located in controller 108 of imaging image forming device 102 so as to accommodate printing and scanning functionality when operating in the standalone mode.

Figure 2:
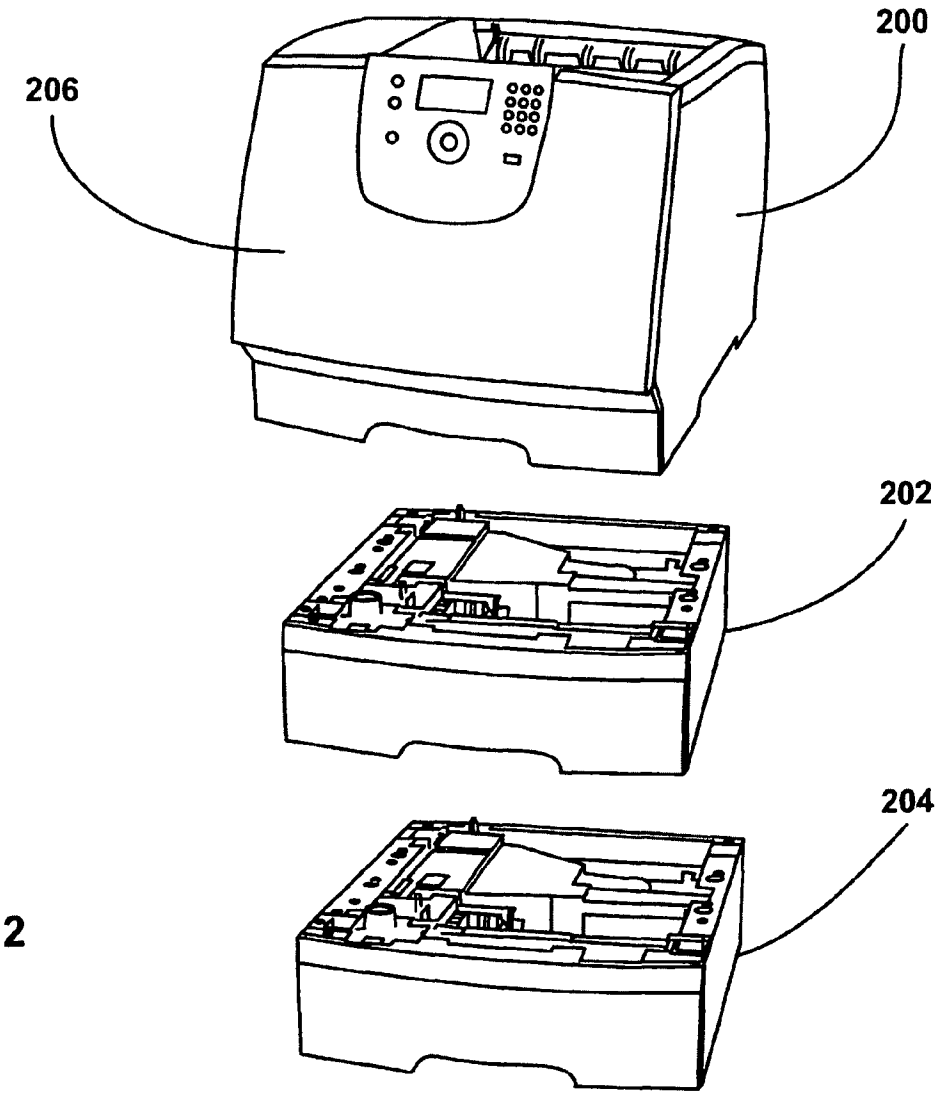
FIG. 2 is an example of an image forming device, RFID module and image input device contemplated herein.

In one example, the removable module may include a shell or a tray, which may be similar to that of a media input tray. FIG. 2 illustrates an image forming device 200, assuming the shape of a laser printer. Below image forming device 200 is a removable RFID module 202 and a media input tray or device 204. As illustrated, the removable RFID module 202 may be positioned or stacked in between the media input tray 204 and the printing device 200 and may have the form of a media input device, including many of the exterior features of the media input device. However, it may be appreciated that more than one media input trays may be present or the RFID module may include a media input tray integrated therein. Furthermore, where more than one media input tray may be present, the RFID module may be positioned between the media input trays.

Figure 3:
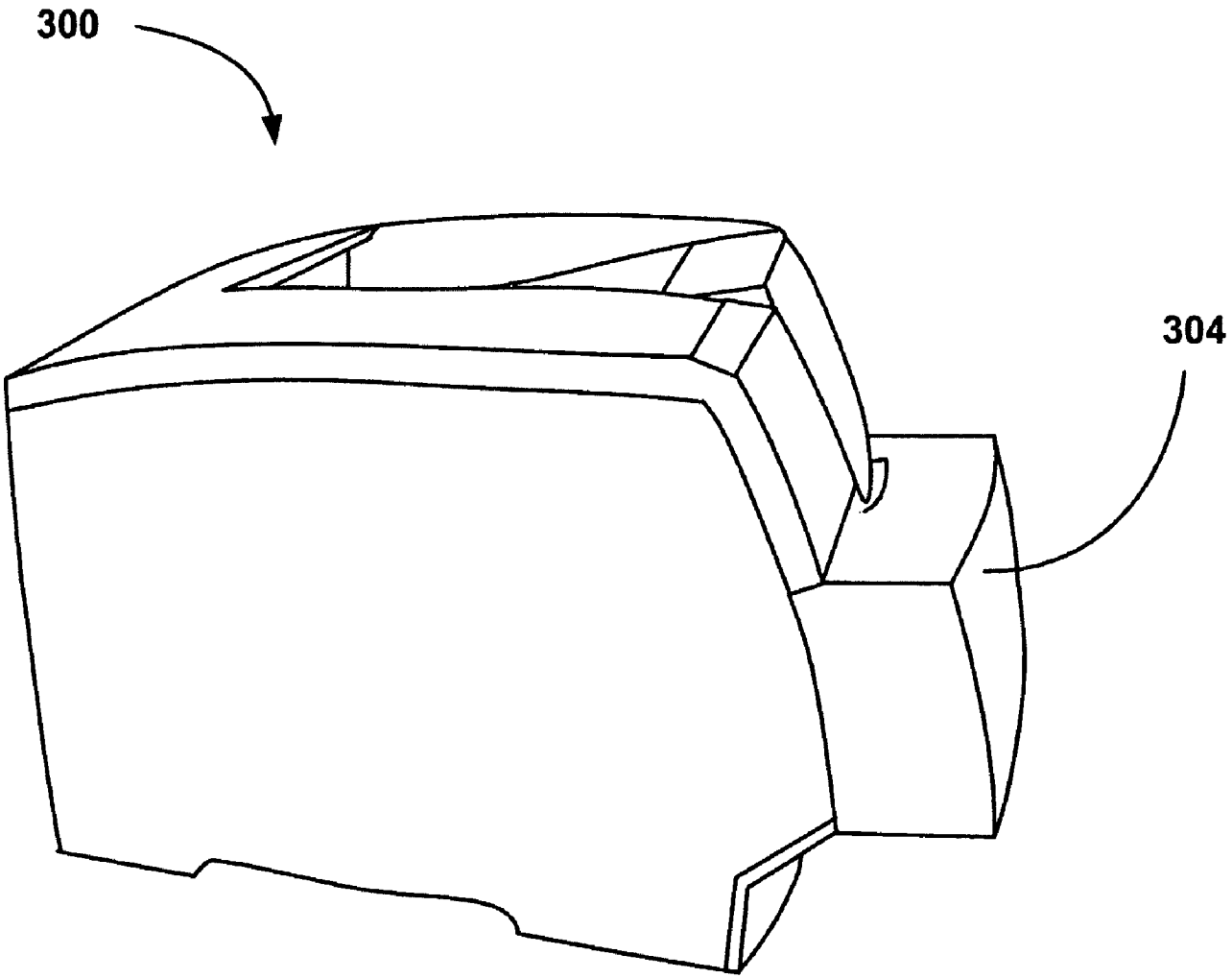
FIG. 3 is an example of an image forming device including an RFID module.
Figure 4:
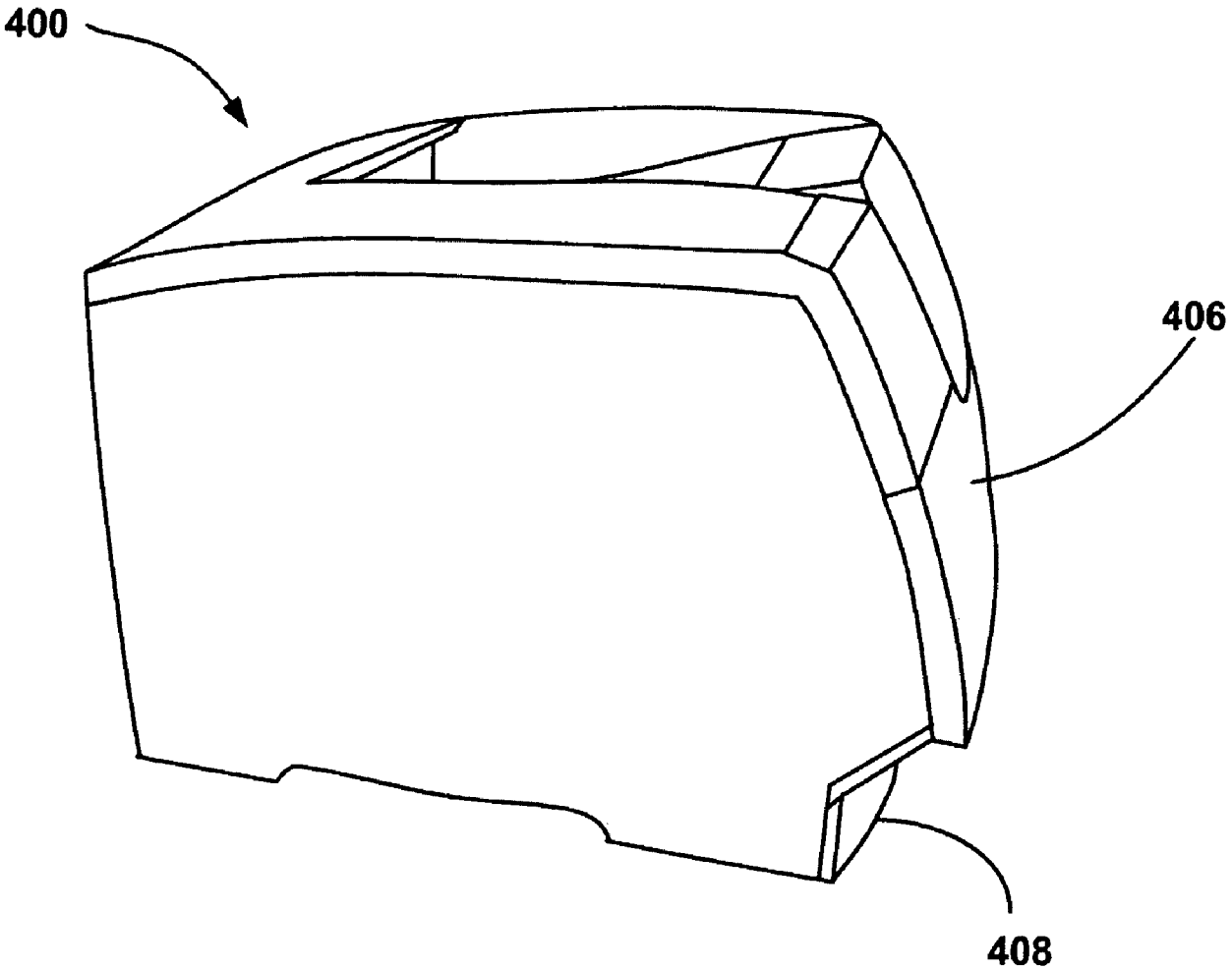
FIG. 4 is another example of an image forming device including an RFID module.

FIG. 3 illustrates another example of an image forming device 300 including a removable RFID module 304, wherein the RFID module may replace the front door cover 206 illustrated in FIG. 2. It may be appreciated that the RFID module may replace other door covers or panels in the printing apparatus. The door covers and/or panels may be made removable or separable from the printer to accommodate the RFID module. In a further example, illustrated in FIG. 4, the RFID module may be positioned within the door cover 406 of the image forming device 400. In another example, the RFID module may be positioned within or replace the multi-purpose tray at the base of the printer 408 or the RFID module may be positioned within the rear door (not illustrated).

Figure 5:
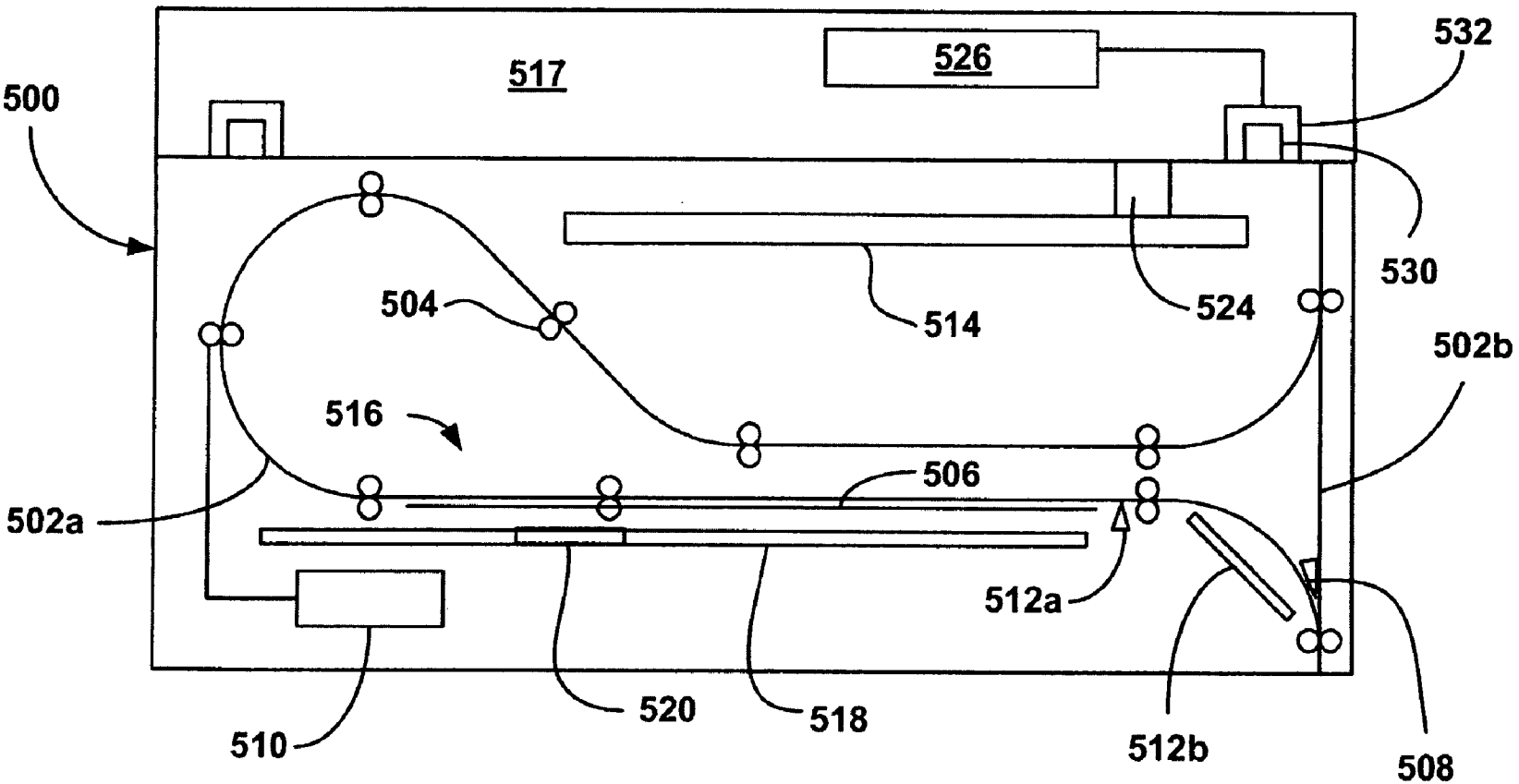
FIG. 5 is an illustration of an example of an RFID module.

One example of an RFID module may generally define at least one paper path for media to pass through and may include a microcontroller, one or more sensors and an RFID reader/programmer for programming RFID tags included in the media. For example, as illustrated in FIG. 5, the RFID module 500 may include a paper path 502*a* and 502*b*, which may be defined in the module by a series of drive rollers 504, guides 506, and/or diverters 508. The drive rollers and/or diverters may be driven by a drive motor 510.

When media includes an RFID tag to be read or programmed, the image forming device may divert the media using a diverter 508 down a portion of the paper path 502*a*, which leads the media past one or more sensors. The sensors may include a position sensor 512*a* and/or antenna sensor 512*b*. A position sensor may sense the position of the media within the RFID module by detecting the leading edge and/or trailing edge of the media. An antenna sensor may detect the presence of an RFID tag and/or read any content that may be present on the RFID tag. The position sensor and/or antenna sensor 512 may communicate electrically or wirelessly with a microcontroller 514.

The microcontroller 514 may be configured, i.e., include circuitry or software, to perform motor control, such that a given sheet of media may be advanced or retracted in the RFID module 500, to align the media with the RFID reader/programmer 518. In addition, the microcontroller 514 may communicate with the image forming device 517. Furthermore, the microcontroller may include circuitry or programming to perform network communications and addition operations. For example, the microcontroller 514 may be in electrical communication with or include an electrical communication port 524. The electrical communications port 524 may provide communications between the microcontroller 514 and a controller 526 within the image forming device 517. Furthermore, the microcontroller may be embedded within a control application specific integrated circuit (ASIC).

The media may then be passed over to a staging area 516 or to a position within the RFID module 500 that is positioned on top of an RFID reader module 518, which may include an associated antenna 520 for performing RFID functions, such as programming the individual RFID tags. Based on the positioning information received by the sensors 512*a* and/or 512*b*, the microcontroller 514 may time programming so that one or more RFID tags on a sheet of media may be programmed with the appropriate information, as, for example, a single sheet of media may include one or more RFID tags and each tag may be programmed with different information. Once the appropriate RFID functions have been completed, the media may then be passed through the remainder of the paper path and fed to an image forming device 517.

The RFID reader/programmer 518 may be an embedded RFID reader module. For example, the RFID reader module 518 may also be embedded in a control ASIC. Examples of such modules may include THINGMAGIC Mercury 4E, available from ThingMagic of Cambridge, Mass., or SIRIT INFINITY 9311, available from Sirit, Inc. of Carrollton, Tex.

The RFID module 500 may also include a set of guides 530 or other locators for locating the RFID module with respect to the printing device. The guides 530 may project from the RFID module and may be received by recesses 532 provided in the base of the image forming device 517. The guides may be mechanically retained by the image forming device 517 or separate mechanical interlocks may be provided to prevent the separation of the RFID module 500 from the image forming device 517.

When the media does not include an RFID tag to be programmed or read, the media may be passed through another portion of the paper path 502*b* and directed towards the image forming device 517. Once again the position sensor and/or antenna sensor 512 may determine the position of the media with in the tray. Such information may be passed to the microcontroller and then to the base printer, which may time printing operations based on the position information obtained by the sensor 512.

Figure 6:
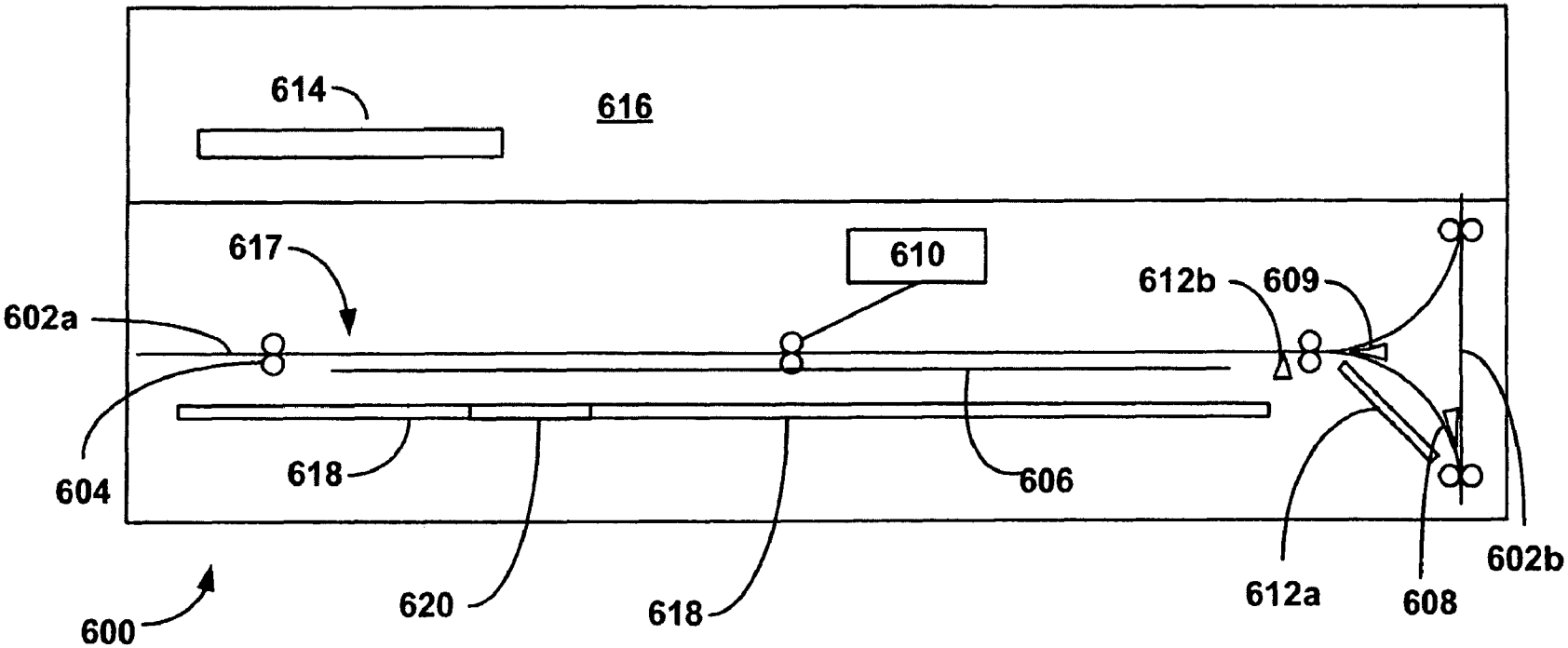
FIG. 6 is an illustration of another example of an RFID module.

As illustrated in FIG. 5, the paper path 502 may be described as a "U" shaped paper path. However, it may be appreciated that other paper paths may be contemplated as well. For example, FIG. 6 illustrates a flat or "V" shaped paper path. In addition, it may be appreciated that the RFID module may not include a microcontroller, but rather received instructions from the controller in the image forming device. The RFID module 600 may include a paper path 602*a* and 602*b*, which again may be defined in the module by a series of drive rollers 604, guides 606, and/or diverters 608. The drive rollers may be driven by a drive motor 610. The rollers, guides and/or diverters in the paper path may direct media through the RFID module 600 and, the direction in which the drive rollers position the media may be controlled by the controller 614 in the image forming device 616.

When media includes an RFID tag to be read or programmed, the controller 614 may divert the media using diverter 608 down a portion of the paper path 602*a*, which leads the media past one or more sensors 612*a* and 612*b*, which may include a position sensor and/or antenna sensor. Once again, the position sensor 612*a* and/or antenna sensor 612*b* may communicate electrically or wirelessly with a controller 614.

The media may then be passed over to a staging area 617 or position in the RFID module 600 that is positioned over or proximate to an RFID reader/programmer 618, which may include an associated antenna 620 for performing RFID functions, such as programming the individual RFID tags. Once the appropriate RFID functions have been completed, the media may then be passed back through the paper path 602*a* and diverted by diverter 609. The media may then be fed to an image forming device 616.

When the media does not include an RFID tag to be programmed or read, the media may be passed through another portion of the paper path 602*b* and directed towards the image forming device 616. Once again the sensors 612*a* and/or 612*b* may determine the position of the media with in the module. Such information may be passed to the microcontroller and then to the base printer, which may time printing operations based on the position information obtained by the sensors 612*a* and/or 612*b*.

Other paper path shapes may be used as well, such as "N" shaped paper paths or "S" shaped paper paths. Or, the paper path may simply be a straight path that passes by the RFID module. It may be appreciated that the paper path shape may be dependent upon the size of the RFID module as well as the location of the RFID module with respect to the image forming device and/or the media input device.

Figure 7:
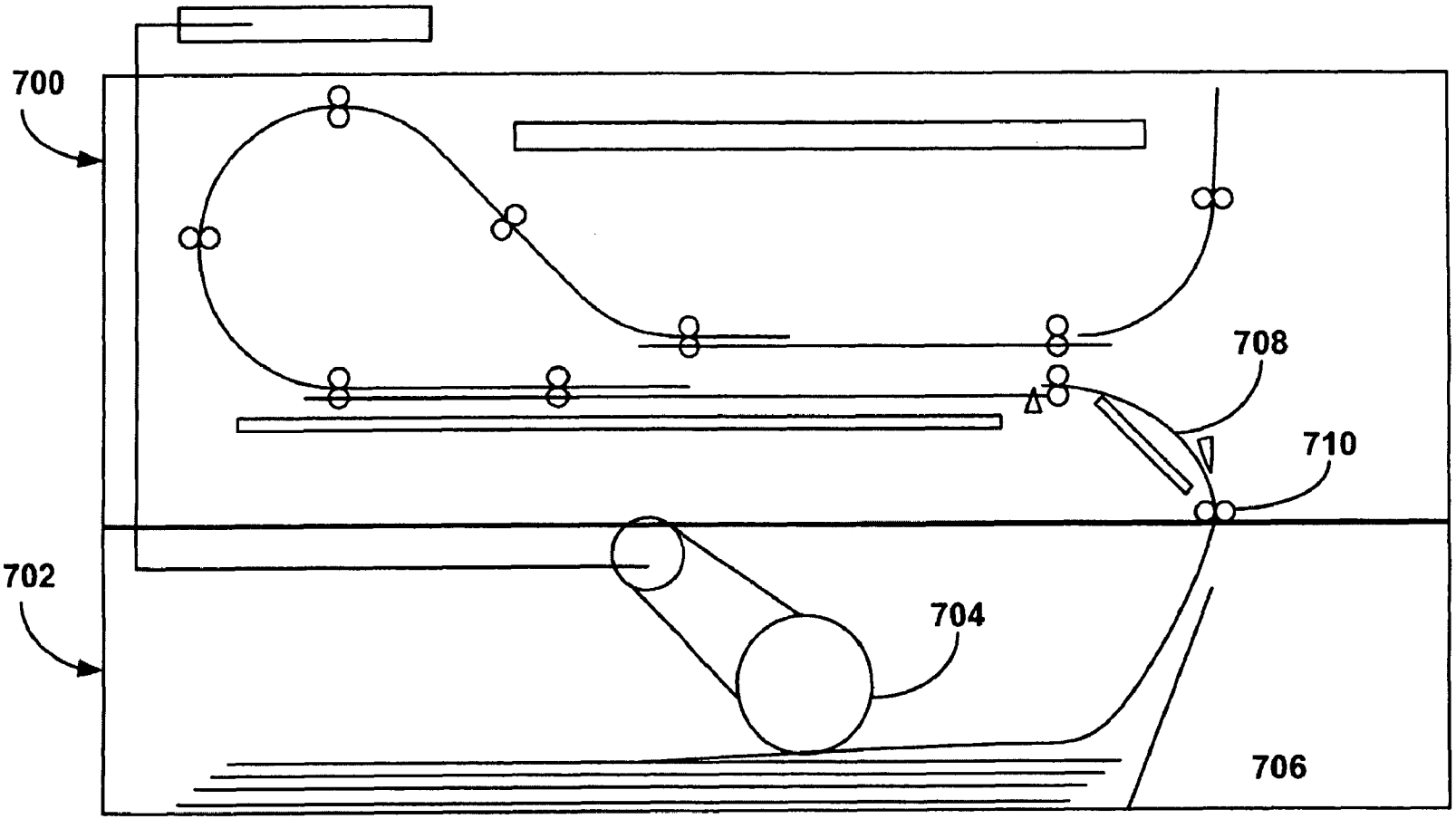
FIG. 7 is an illustration of an example of an RFID module and a media input device.

The media input device may be placed such that the paper path of the media input device may communicate with the paper path of the RFID device. FIG. 7 illustrates an example of a media input device 702, in this case a media input tray, used in connection with an RFID module 700. The media input device may include a pick mechanism 704 which feeds the media, by applying a force against the media to direct the media up against a wall 706 of the media tray. The media paper path in the tray may align with or communicate with the media paper path 708 in the RFID module 700, such that, for example, the media may feed right into the module rollers 710.

Figure 8:
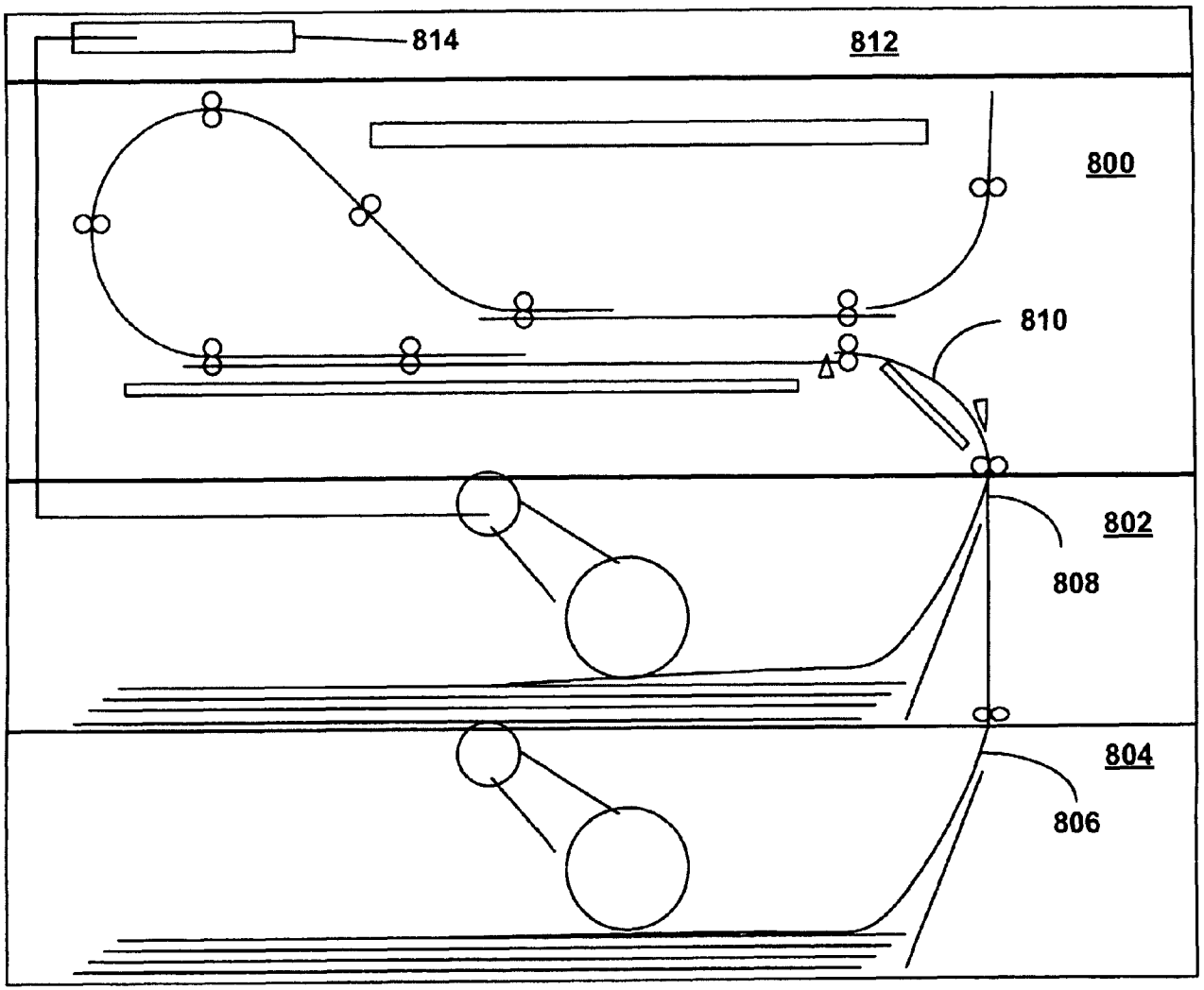
FIG. 8 is an illustration of another example of an RFID module and more than one media input devices.

It may be appreciated, the RFID module 800 may receive media from more than one media input tray 802 and 804, wherein the media may be fed through consecutive paper paths 806 and 808 defined in the trays until the paper path 810 in the RFID device 800 has been reached. In one example, illustrated in FIG. 8, the controller 814 in the image forming device 812 may command the pick mechanism in the other trays to feed media into the RFID module 800 and coordinate RFID functionally. In another example, the RFID module 800 may be configured to control the pick mechanisms in the additional trays 802 and 804 either directly, or indirectly through the image forming device, and coordinate RFID functionality on its own.

Figure 9:
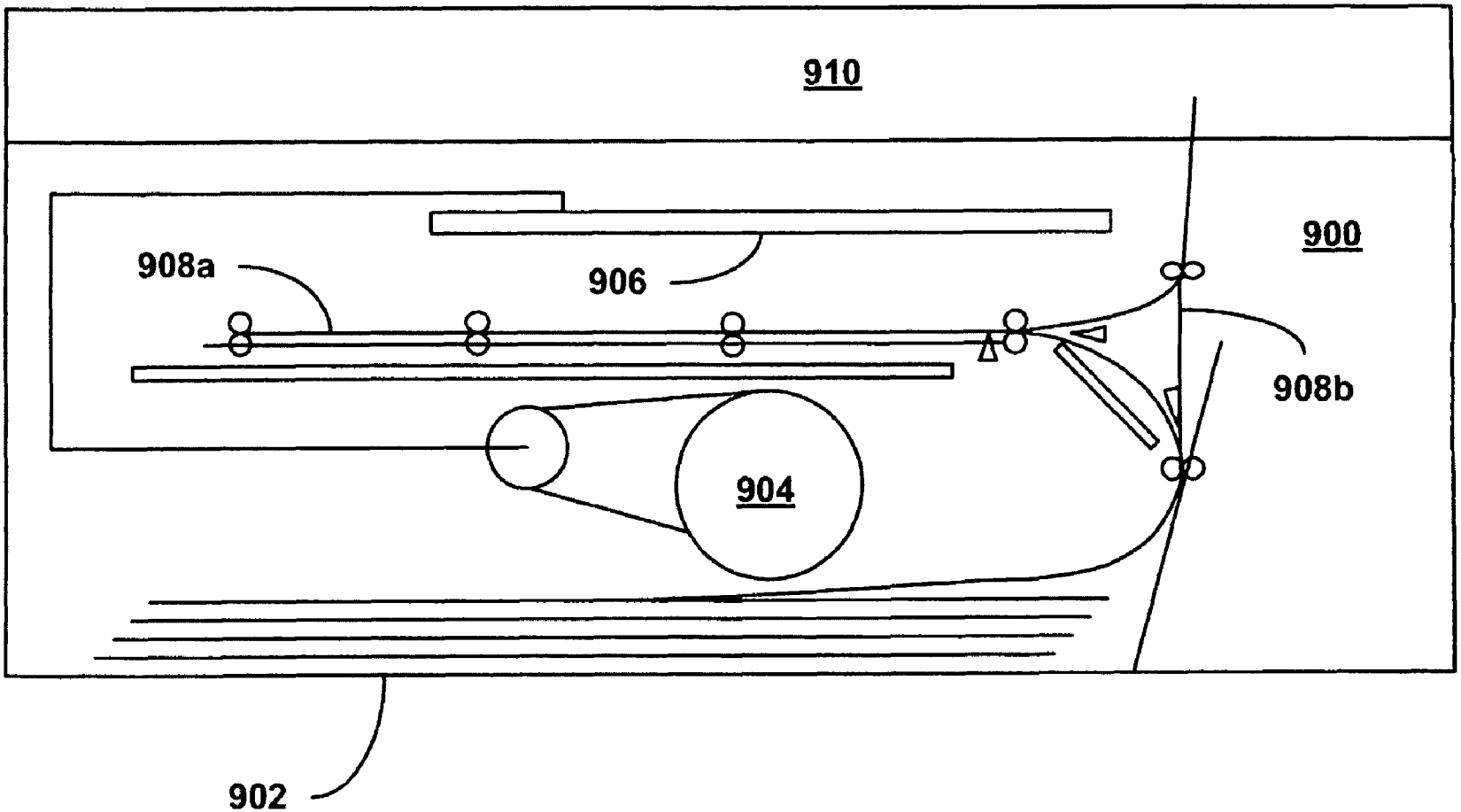
FIG. 9 is an illustration of an RFID module including an integrated media input device.

In another example, illustrated in FIG. 9, the media input tray may be integrated into the RFID module 900. As illustrated, the RFID module may include an area for providing a stack of media 902 and a pick device 904 for picking sheets of media. The pick device 904 may communicate with the microcontroller 906. Where RFID functionality is necessary, the media may pass back and forth through paper path 908*a* and where RFID functionality is not necessary, the media may pass through paper path 908*b* and directly into the image forming device 910. Or in another embodiment, the pick device may pick the media in an opposite direction to that illustrated and the media mass pass through paper path 908*a* regardless of whether RFID functionality may be utilized by the RFID module 900.

Figure 10:
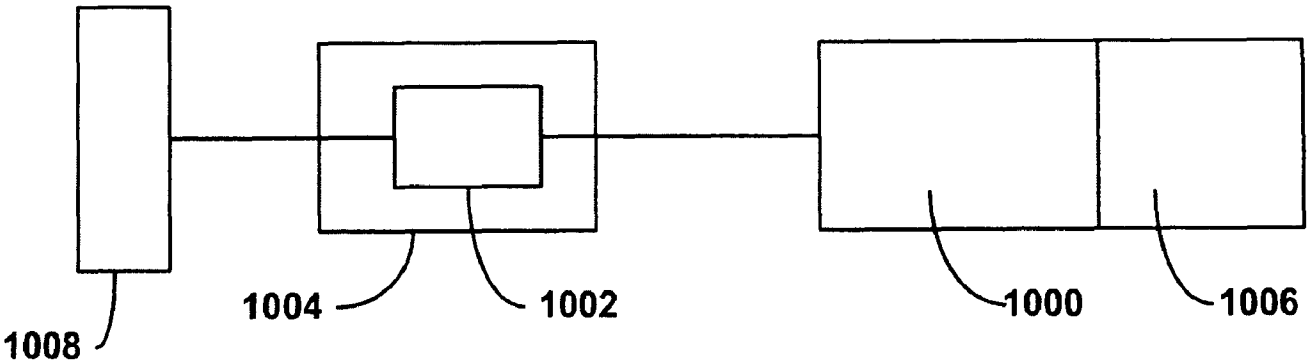
FIG. 10 is an illustration of an example of a RFID module in communication with an image forming apparatus and a computer or network.

The RFID module may be operated as a slave device to the image forming device, as illustrated in FIG. 10, wherein the RFID module 1000 is directed or controlled by a controller 1002 within the image forming device 1004. When a print job is received by the image forming device 1004, the image forming device may process the print job and send a request to the RFID module 1000 for each sheet of media along with the tag data for each sheet. The RFID module 1000 may then feed media from an input source 1006, program tags in the media and feed the media to the into the image forming device 1004 based on the commands from the controller 1002. In such a manner, the controller 1002 in the image forming device, be it in firmware, software or hardware, may be capable of processing the RFID data and controlling the RFID module 1000. The print job may be received from a computer or a network device 1008, be it a wireless device or via an electrical connection.

Figure 11:
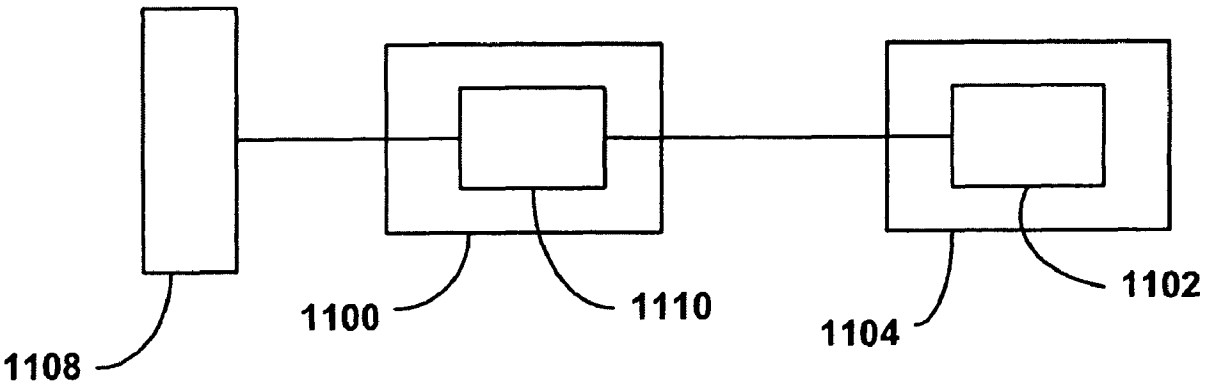
FIG. 11 is an illustration of another example of an RFID module in communication with an image forming device and a computer or network.

In another embodiment, illustrated in FIG. 11, the microcontroller 1110 in the RFID module 1100 may receive data from a computer or a network device 1108. The RFID module 1100 may then process the print job and extract any RFID data and modify the job as necessary by, for example, breaking the job up into single page elements. The modified print job may then be directed to the image forming device 1104. In such a manner, a standard controller 1102 that does not include RFID processing software may be utilized in conjunction with RFID module to provide RFID functionality.

Figure 12:
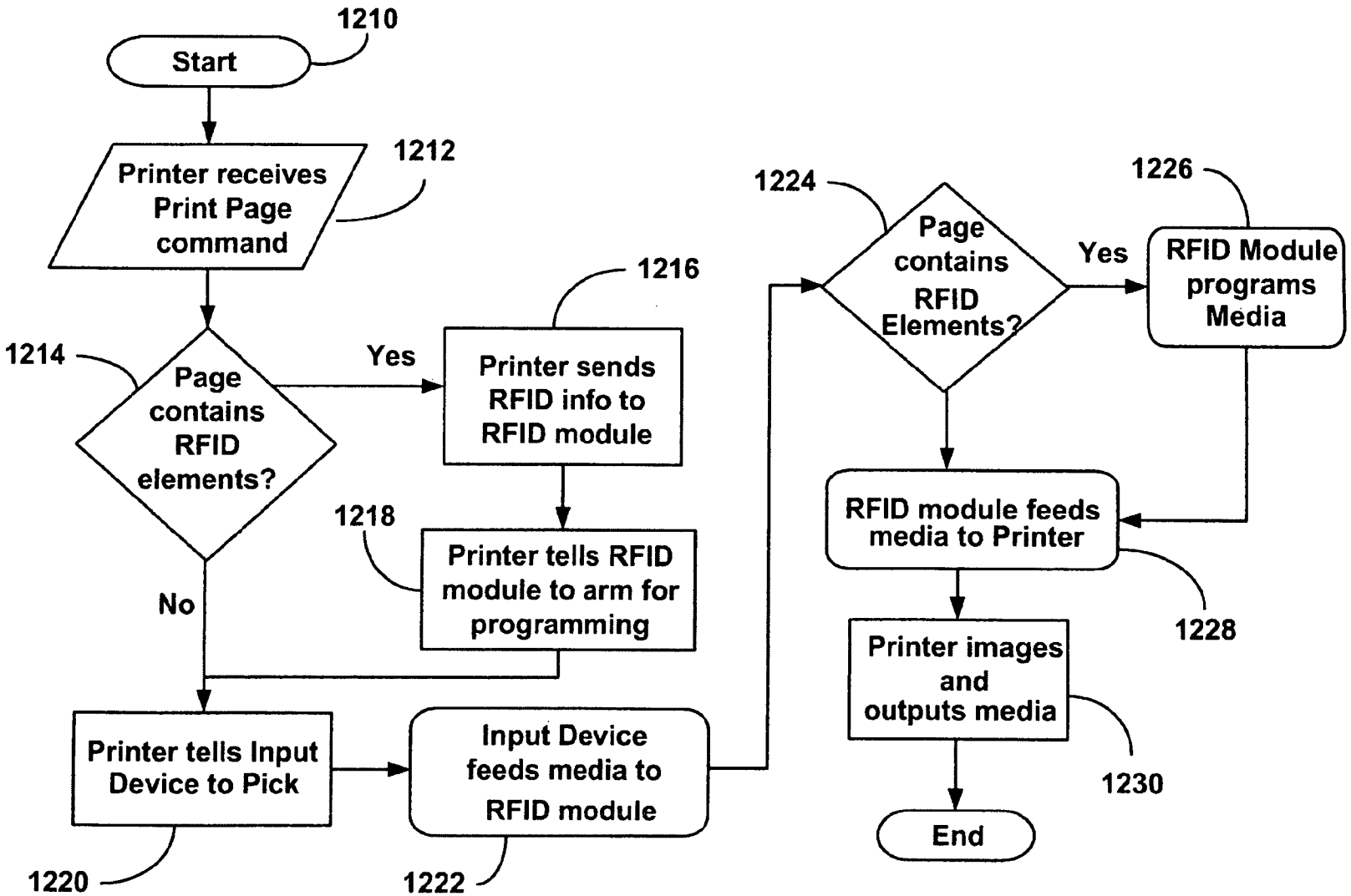
FIG. 12 is an illustration of an example of a method for printing with the RFID module.

FIG. 12 illustrates an example of a flow diagram as to how a method of printing using an RFID module may operate. At the start of the process 1210 a print job may be issued by a computer or another network device. The print job may be processed by the image forming device or printer controller and the printer may receive a print page command 1212, i.e., a command to print a page in a print job. A determination may then be made as to whether the print page includes RFID data 1214.

When a determination is made that the print page includes RFID data 1214, the print controller may then send RFID data to the RFID module 1216. The printer may then arm the RFID device for programming 1218. Regardless of the presence of RFID data, the printer may send a pick command to a pick mechanism in an appropriate media input device 1220, which may be within the RFID module or an input device having a paper path that may be directly or indirectly in communication with said RFID module. The media input device may then feed the media to the RFID module 1222.

An evaluation may be made as to whether the page contains RFID elements 1224. Where RFID elements are present, the RFID module may program the media 1226. When RFID elements are not present, or after the media has been programmed, the media may be fed to the printer 1228, which may be controlled by the RFID module or the printer itself. The printer may then provide images and output the media 1230.

Figure 13:
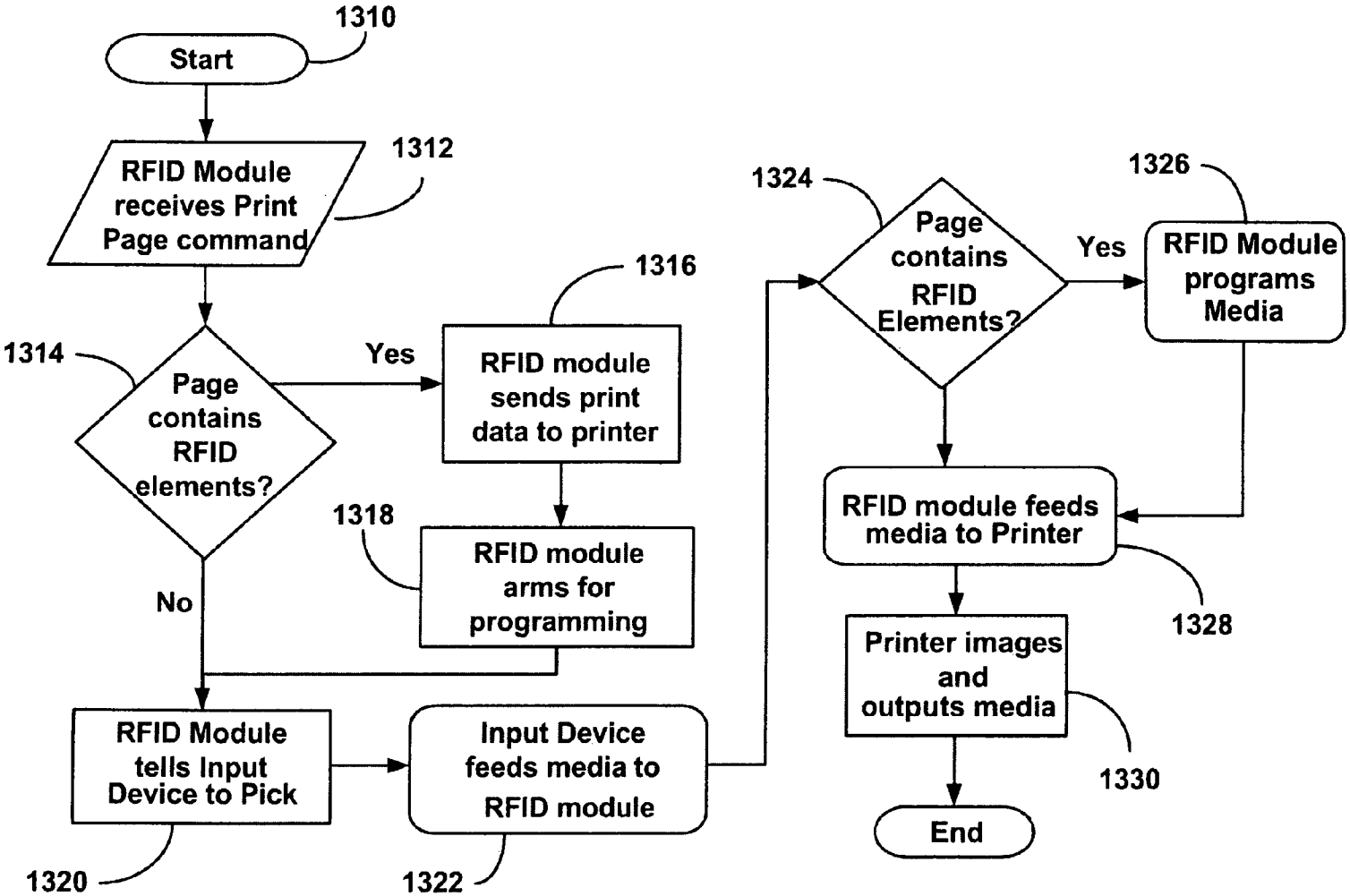
FIG. 13 is an illustration of another example of a method for printing with the RFID module.

FIG. 13 illustrates another example of a method of using an RFID module where the print job may be received 1310 and processed by the RFID module 1312. A determination may be made as to whether an individual page may include RFID elements 1314. Where RFID elements are present, the RFID module may send print pages without RFID data to the printer and process the RFID information 1316. The RFID module may then arm itself for programming 1318.

The RFID module may then send a command to the media input device to pick a sheet of media 1320. The media input device may then feed the media to the RFID module 1322. When RFID elements are detected as being present 1324, the RFID device may program the RFID tags or elements contained in the media 1326. Otherwise, with or without the elements, the RFID module may then feed the media to the printer 1328. The printer may then print and output the media 1330.

It may be appreciated that other modules imparting other functionality may be provided for use in conjunction with the RFID module. For example, a duplex module, which may provide a paper path arrangement for providing duplex print jobs, may be provided atop the RFID module.

Figure 14:
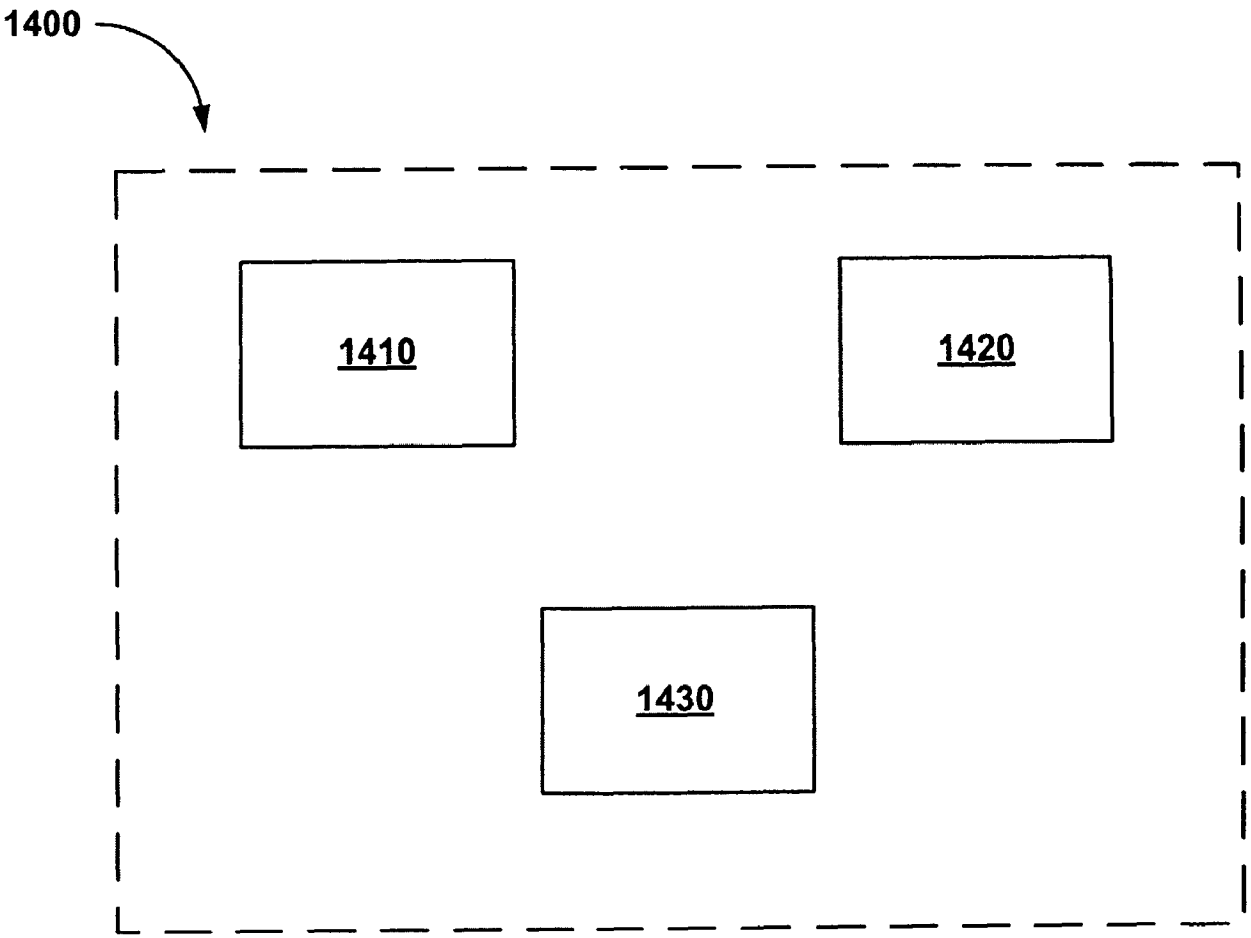
FIG. 14 is an illustration of an article of machine readable media in relation to a processor and a user interface.

It should also be appreciated that the functionality described herein for the embodiments of the present invention may be implemented by an article, such as hardware, software, or a combination of hardware and software, either within the printer or copier or in the RFID module, as desired. If implemented by software, a processor and a machine readable medium are required. The processor may be of any type of processor capable of providing the speed and functionality required by the embodiments of the invention and may include, for example, a controller or microcontroller. Machine-readable memory includes any media capable of storing instructions adapted to be executed by a processor. Some examples of such memory include, but are not limited to, read-only memory (ROM), random-access memory (RAM), programmable ROM (PROM), erasable programmable ROM (EPROM), electronically erasable programmable ROM (EEPROM), dynamic RAM (DRAM), magnetic disk (e.g., floppy disk and hard drive), optical disk (e.g. CD-ROM), and any other device that can store digital information. The instructions may be stored on medium in either a compressed and/or encrypted format. Accordingly, in the broad context of the present invention, and with attention to FIG. 14, the RFID module and/or image forming device 1400 may contain a processor 1410 and machine readable media 1420 and user interface 1430 directly or indirectly in communication with the RFID module or image forming device.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A device for providing RFID functionality to an image forming device, comprising:

an RFID module removable from the image forming device, said RFID module defining a first paper path configured to communicate with a second paper path defined in the image forming device;

an RFID reader/programmer positioned within said module in electrical communication with the image forming device; and an RFID antenna positioned within said module in electrical communication with said RFID reader/programmer;

wherein when programming at least one RFID programmable element embedded in or positioned on a media sheet by said RFID reader/programmer, said media sheet passes through said first paper path, and when not programming said at least one RFID programmable element, said media sheet passes through said second paper path directly into said image forming device without passing through said first paper path.

2. The device of claim 1, wherein said module is in the form of a media input device.

3. The device of claim 1, further comprising an electrical communication port, in electrical communication between said RFID reader/programmer and the image forming device.

4. The device of claim 1, further comprising a media input device defining a third paper path, wherein said third paper path communicates with said first paper path.

5. The device of claim 1, wherein said module includes a media input device comprising a pick mechanism.

6. The device of claim 1, further comprising a micro controller positioned within said module in electrical communication with said RFID reader/programmer and the image forming device.

7. The device of claim 1, further comprising a non-transitory storage medium having stored thereon instructions that when executed by a machine result in the following operations:

receiving a print job;

determining if said print job includes RFID data;

providing media to said first paper path defined in said removable RFID module when RFID data is included in said print job;

programming said at least one RFID programmable element included in or positioned on said media;

providing said media to said second paper path defined in the image forming device; and forming an image on said media.

8. The device of claim 1, wherein said first paper path defined by said RFID module comprises a substantially U-shaped paper path.

9. The device of claim 1, wherein said removable RFID module includes an area for providing a stack of media and a pick device for picking sheets of media from said stack.

10. The device of claim 1, wherein said removable RFID module replaces a cover of the image forming device upon separation of the cover from the image forming device.

11. The device of claim 1, wherein said first paper path defined by said RFID module comprises a substantially flat paper path in which media sheets reverse directions when passing through said substantially flat paper path.

12. A system for providing RFID functionality, comprising:

an image forming device including a controller and defining a first paper path; and an RFID module removable from said image forming device, said RFID module defining a second paper path in communication with said first paper path, said module comprising:

an RFID reader/programmer positioned within said module in electrical communication with said controller, said RFID reader/programmer for programming RFID programmable elements included in media sheets passing through said second paper path; and an RFID antenna positioned within said module in electrical communication with said RFID reader/programmer;

wherein a media sheet including at least one RFID programmable element passes through said second paper path when said at least one RFID programmable element is to be programmed by said RFID reader/programmer, and said media sheet passes through said first paper path and directly into the image forming device without passing through said second paper path when said at least one RFID programmable element included in said media sheet is not to be programmed by said RFID reader/programmer.

13. The system of claim 12, wherein said module is in the form of a media input device.

14. The system of claim 12, further comprising an electrical communication port, in electrical communication between said RFID reader/programmer and said controller.

15. The system of claim 12, further comprising a microcontroller positioned within said module in communication with said RFID reader/programmer and said controller.

16. The system of claim 12, further comprising a non-transitory storage medium having stored thereon instructions that when executed by a machine result in the following operations:

receiving a print job;

determining if said print job includes RFID data;

providing media to said second paper path defined in said removable RFID module when RFID data is included in said print job;

programming said at least one RFID programmable elements included in said media;

providing said media to said first paper path defined in the image forming device; and forming an image on said media.

17. The system of claim 16, wherein said controller includes said storage medium.

18. A method of controlling an image forming device including removable RFID functionality, comprising:

receiving a print job;

determining if said print job includes RFID data;

sending RFID data to a removable RFID module when said RFID data is included in said print job;

providing media to a first paper path defined in said RFID module when said RFID data is included in said print job;

programming one or more RFID programmable elements included in said media;

providing said media to a second paper path defined in an image forming device; and forming an image on said media.

19. The method of claim 18, wherein said print job is received by a controller in said image forming device.

20. The method of claim 18, further comprising providing said RFID data to an RFID reader/programmer in said RFID module to program said media.

21. The method of claim 18, wherein said RFID data is provided to a microcontroller in said RFID module.

22. The method of claim 18, wherein said media is provided to said RFID module from a media input device having a third paper path in communication with said first paper path.

23. An article, comprising a non-transitory storage medium having stored thereon instructions that when executed by a machine result in the following operations:

receiving a print job;

determining if said print job includes RFID data;

providing media to a first paper path defined in a removable RFID module when RFID data is included in said print job;

programming one or more RFID programmable elements included in said media;

providing said media to a second paper path defined in an image forming device; and forming an image on said media.

24. The article of claim 23, wherein said print job is received by a controller in an image forming device.

25. The article of claim 23, wherein said instructions that when executed by said machine result in the following additional operations: providing said RFID data to a microcontroller included in said RFID module when said RFID data is included in said print job.

26. The article of claim 23, wherein said instructions that when executed by said machine result in the following additional operations: providing said RFID data to an RFID reader/programmer in said module to program said media.

27. The article of claim 23, wherein said print job is received by said RFID module.

28. The article of claim 23, wherein said instructions that when executed by said machine result in the following additional operations: wherein said media is provided to said RFID module from a media input device including a third paper path in communication with said first paper path.

* * * * *